United States Patent [19]

Nasiatka

[11] Patent Number: 5,025,968

[45] Date of Patent: Jun. 25, 1991

[54] FURNITURE TOOL

[75] Inventor: John R. Nasiatka, Northbrook, Ill.

[73] Assignee: Duo-Fast Corporation, Franklin Park, Ill.

[21] Appl. No.: 367,787

[22] Filed: Jun. 19, 1989

[51] Int. Cl.[5] ..... B25C 5/06

[52] U.S. Cl. ..... 227/8; 227/31; 227/64

[58] Field of Search ..... 227/8, 20, 26, 31, 32, 227/38, 43, 64

[56] References Cited

U.S. PATENT DOCUMENTS

| | | | |
|---|---|---|---|
| 3,141,171 | 7/1964 | Doyle et al. . | |
| 3,633,810 | 1/1972 | Krakauer | 227/20 |
| 3,638,532 | 2/1972 | Novak | 91/220 |
| 3,727,821 | 4/1973 | Pabich et al. | 227/120 |
| 3,734,377 | 5/1973 | Munn | 227/120 |
| 4,033,499 | 7/1977 | Butler et al. | 227/120 |
| 4,424,929 | 1/1984 | Weis | 227/32 |
| 4,485,952 | 12/1984 | WEis | 227/32 X |
| 4,550,634 | 11/1985 | Schwartzenberger | 91/356 |

FOREIGN PATENT DOCUMENTS

| | | | |
|---|---|---|---|
| 0218778 | 4/1987 | European Pat. Off. . | |
| 0023777 | 2/1977 | Japan | 227/32 |
| 1028071 | 4/1966 | United Kingdom . | |
| 2024691A | 1/1980 | United Kingdom . | |

*Primary Examiner*—Frank T. Yost
*Assistant Examiner*—Rinaldi Rada

[57] ABSTRACT

A fastener driving tool for fabricating upholstered furniture and particularly for securing furniture clips, such as a J-type spring clip, to a wood furniture frame. The furniture clips are used to suspend furniture springs across the furniture frame. The tool includes a pivotally mounted magazine which prevents the tool from being operated unless the nosepiece is in engagement with a workpiece. In order to facilitate alignment of the furniture clips with respect to the fasteners, the nosepiece is formed as a guide for aligning the furniture spring clip with respect to the fastener drive track.

25 Claims, 3 Drawing Sheets

FURNITURE TOOL

BACKGROUND OF THE INVENTION

1. Field of the Invention

This invention relates to a fastener driving tool and, more particularly, to a fastener driving tool for securing J-type furniture spring clips to a wood furniture frame. The fastener driving tool has a nosepiece adapted to position the furniture clip with respect to the fastener and a pivotally mounted magazine and nosepiece assembly which prevents the tool from being operated unless the nosepiece is in engagement with a workpiece.

2. Description of the Prior Art

Known fastener driving tools are provided with safety yokes, reciprocally mounted with respect to the nosepiece. In order to prevent unintentional operation of the fastener driving tool, the safety yoke is interlocked with the motive power source for the tool to prevent the tool from operating when the nosepiece is not in engagement with a workpiece. For example, in Doyle et al U.S. Pat. No. 3,141,171, assigned to the same assignee as the present invention, an electrically operated fastener driving tool is disclosed having a reciprocally mounted safety yoke. A safety switch, disposed adjacent the safety yoke, is responsive to the position of the safety yoke. The safety switch is serially connected to the electrical power supply for the tool and prevents operation of the tool unless the safety switch contact is in a closed position. The closed position of the safety switch corresponds to a condition when the nosepiece is in engagement with a workpiece. When the nosepiece is not in engagement with a workpiece, the safety switch contact is in an open position and prevents operation of the tool.

Some known fastener driving tools are provided without a safety yoke. Such fastener driving tools are often used in the construction of upholstered furniture to secure furniture spring clips to a wood furniture frame. The safety yokes have to be eliminated on such tools because there is no bearing surface for the safety yoke at each location where a staple must be driven into the furniture spring clip for proper installation. However, in order to prevent operation of the fastener driving tool not provided with a safety yoke, other types of safety interlocks have been provided. For example, Doyle et al U.S. Pat. No. 3,141,171 also discloses a pivotally mounted magazine, interlocked with the electric motive power source, which prevents operation of the tool when the nosepiece is not in engagement with the workpiece. More specifically, a magazine is provided pivotally mounted at the rear end of the tool. The front end of the magazine is attached to a reciprocally mounted nosepiece. When the nosepiece engages a workpiece, the nosepiece as well as the magazine move upwardly. This upward movement of the magazine and nosepiece actuates a safety switch, interlocked with the tool drive circuit to allow the tool to be operated. However, such fastener driving tools are generally light duty and are not suitable for driving staples into furniture spring clips. Consequently, such tools have no means to align the fastener with respect to the furniture clips.

SUMMARY OF THE INVENTION

It is an object of the present invention to provide a fastener driving tool for fabricating upholstered furniture which overcomes the problems associated with the prior art.

It is another object of the present invention to provide a fastener driving tool which provides a guide for aligning the fastener with respect to the furniture clip.

Briefly, the present invention relates to a fastener driving tool used to fabricate upholstered furniture and, more particularly, to a tool used to secure a furniture clip, such as a J-type clip, to a wood furniture frame. The tool includes a pivotally mounted magazine and nosepiece assembly which prevents the tool from being operated unless the nosepiece is in engagement with a workpiece. In order to facilitate alignment of the furniture spring clips with respect to the tool, the nosepiece is formed with a guide for aligning the furniture spring clip with respect to a fastener drive track.

DESCRIPTION OF THE DRAWING 7 These and other objects and advantages of the present invention will become readily apparent upon consideration of the following detailed description and attached drawing, wherein:

FIG. 8 is a perspective view of the J-type furniture spring clip to be received in the furniture clip guide in accordance with the present invention;

DETAILED DESCRIPTION

Figure 2:
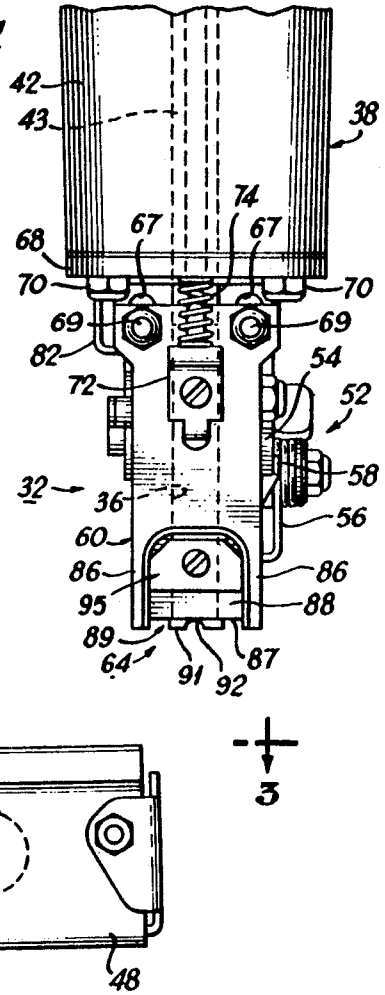
FIG. 2 is a partial front view along line 2—2 of FIG. 1.
Figure 1:
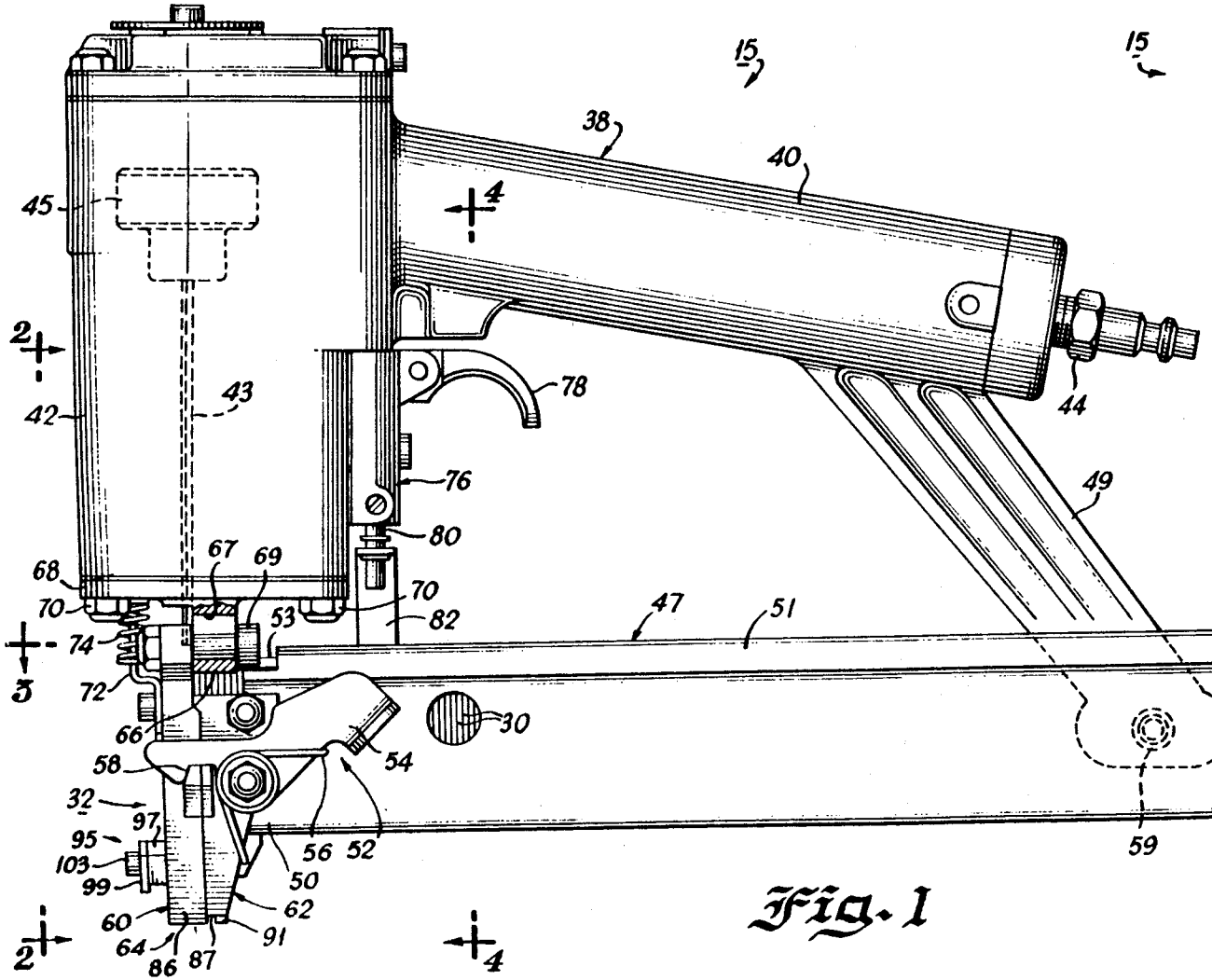
FIG. 1 is a side elevational view of the fastener driving tool in accordance with the present invention.
Figures 3, 4, 5, 6:
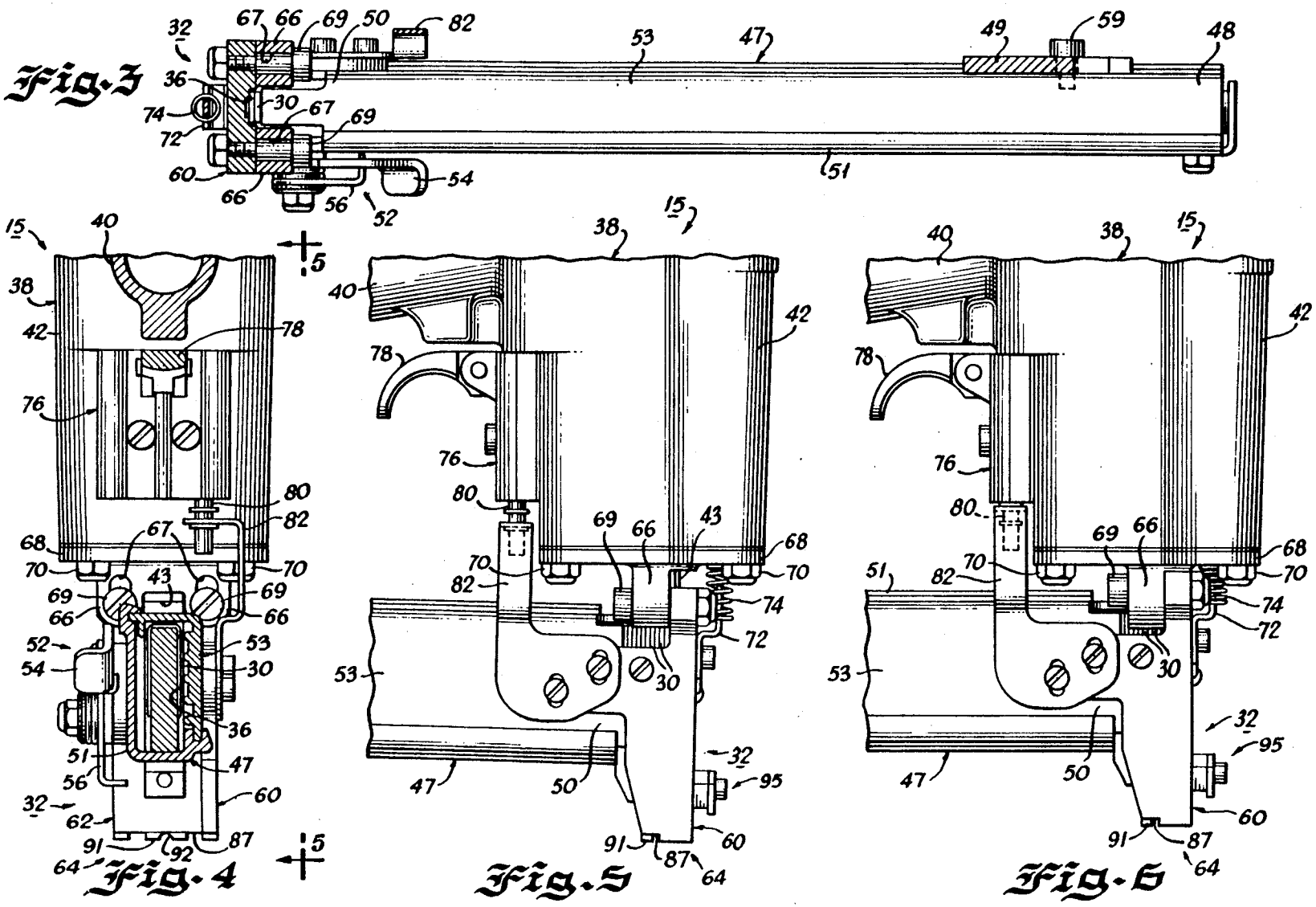
FIG. 3 is a plan sectional view along line 3—3 of FIG. 1.
FIG. 4 is a cross-sectional view along line 4—4 of FIG. 1.
FIG. 5 is a side elevational view along line 5—5 of FIG. 4.
FIG. 6 is similar to FIG. 5 illustrating the tool in accordance with the present invention in an operative position.

The tool 15 in accordance with the present invention is used to fabricate upholstered furniture. More specifically, the tool 15 is used to secure J-type furniture spring clips 20 (illustrated in FIGS. 8–13), to a wood furniture frame 21. The furniture spring clips 20 are used to suspend furniture springs, such as "no-sag" springs across parallel and spaced apart furniture frame members 21.

A typical J-type furniture spring clip 20 consists of a short depending leg portion 22, a shank portion 24 and a bight portion 25. The bight portions 25 of the furniture spring clips 20 hold the ends of the furniture springs 23. The shank portions 24 rest on the furniture frame 21.

Each shank portion 24 is provided with two spaced apart elongated slots 26, disposed parallel to the longitudinal axis of the furniture spring clip 20. The short depending leg portion 22 is provided with a pair of apertures 28. The apertures 28 are aligned with the slots 26 in the shank portion 24.

Figures 7, 9, 10, 11, 12, 13:
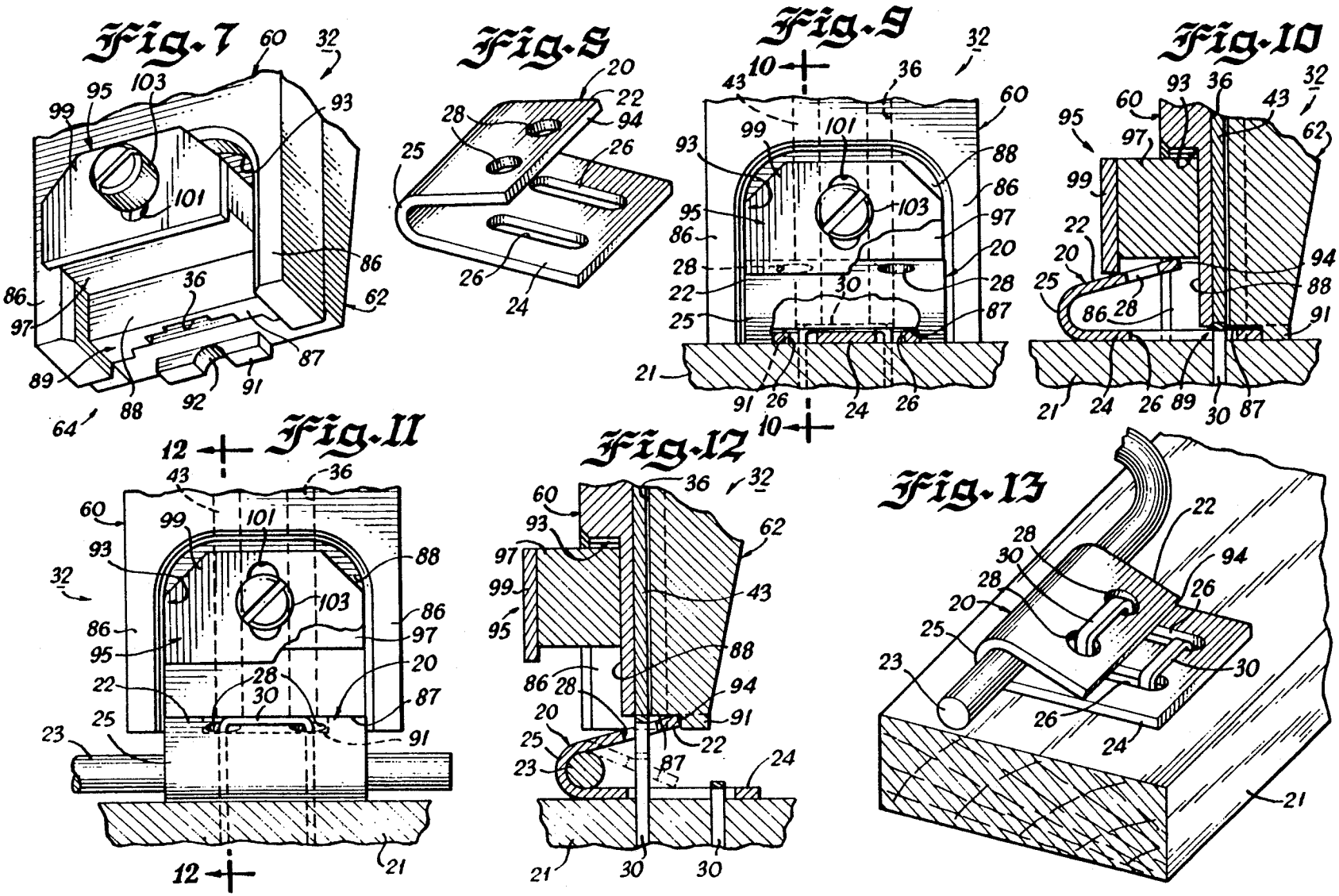
FIG. 7 is a fragmentary perspective view of the nosepiece assembly in accordance with the present invention.
FIG. 9 is a partial front elevational view of the nosepiece in accordance with the present invention in an operative position.
FIG. 10 is a cross-sectional view along line 10—10 of FIG. 9.
FIG. 11 is similar to FIG. 9 illustrating the tool in another operative position.
FIG. 12 is a cross-sectional view along line 12—12 of FIG. 11.
FIG. 13 is a perspective view of a furniture spring clip secured to a furniture frame including the furniture spring.

Two staples 30 are used to secure each furniture spring clip 20 to the furniture frame 21. One staple 30 is driven through the slots 26 to secure the furniture clip 20 to the furniture frame 21. The ends of a furniture spring 23 are then received in the bight portions 25 of furniture spring clips 20 disposed on spaced apart and parallel furniture frame members 20 to suspend the springs 23 across the furniture frame 21. Since the slots 26 are aligned with the apertures 28, the second staple 30 is driven through both the apertures 28 and the slots 26 and into the furniture frame 21. The second staple 30 thus secures the furniture spring clip 20 to the furniture frame 21 and also captures the end of the furniture spring 23 in the bight portions 25 of the furniture spring clip 20 by bending the short depending leg portion 22 down and around the spring 23 as shown in FIGS. 12 and 13.

The tool 15 in accordance with the present invention is for fastening the furniture spring clips 20 to the furniture frame 21. The tool 15 has a nosepiece assembly 32 formed as a guide for positioning the tool 15 and, specifically, the drive track 36 with respect to the apertures 28 and the slots 26 in the furniture spring clip 20. The tool 15 includes a housing 38 having a handle portion 40 and a vertical portion 42. A pneumatic fitting 44 is disposed at the rear of the handle portion 40, which acts as a pneumatic reservoir. A drive assembly includes a pneumatically operated drive piston 45 reciprocally disposed within a cylinder formed in the vertical portion 42 of the housing 38. A drive blade 43 is rigidly attached to the drive piston 45 and aligned with the drive track 36 formed in the nosepiece assembly 32. Staples 30 are driven by the drive blade 43 through the drive track 36 and into a workpiece. The drive assembly is described in detail in U.S. Pat. No. 3,638,532, assigned to the same assignee as the present invention, hereby incorporated by reference.

A magazine assembly 47 is disposed generally perpendicularly to the drive track 36. The magazine assembly 47 carries a plurality of staples 30, biased toward the drive track 36. The magazine assembly 47 includes a cover portion 53 and a slidably mounted carrier portion 51. The carrier portion 51 is adapted to be slidably mounted along an axis generally perpendicular to the drive track 36 to allow the magazine assembly 47 to be opened and refilled. A latch assembly 52 consisting of a latch lever 54 and a torsion spring 56, is used to latch the carrier portion 51 to latch surfaces 58 formed in the nosepiece assembly 32.

An important aspect of the invention relates to the pivotally mounted magazine assembly 47 and nosepiece assembly 32. More specifically, the rear portion 48 of the magazine assembly 47 is provided with a bore, aligned with a bore in a depending arm 49. A suitably sized screw 59 and spacer is received in the bores to couple the magazine assembly 47 to the depending arm 49 to allow pivotal movement of the magazine assembly 47.

The front portion 50 of the magazine assembly 47 is attached to the nosepiece assembly 32. The nosepiece assembly 32 is formed from a front and a rear nosepiece 60 and 62, respectively. The magazine assembly 47 is coupled to the front nosepiece 60 which, in turn, is coupled to downwardly depending flanges 66 having slots 67 with one or more shoulder screws 69 to allow pivotal movement about the screw 59 at the rear of the magazine assembly 47. The flanges 66 may be integrally formed on a plate 68, attached to the lower front portion of the housing 38. The plate 68 is attached to the housing 38 with a plurality of fasteners 70. Downward movement of the front portion 50 of the magazine assembly 47 and nosepiece assembly 32 is limited by the screws 69 in the slots 67. Upward movement of the front portion 50 of the magazine assembly 47 and nosepiece assembly 32 is limited by the contact of the top surface of the front nosepiece 60 with a bottom surface of the plate 68.

The front nosepiece 60 is formed with a spring retainer 72. The spring retainer 72 consists of an upwardly extending T-shaped member for receiving a biasing spring 74 to bias the magazine assembly 47 and nosepiece assembly 32 downwardly when the nosepiece assembly 32 is not in engagement with a workpiece. More specifically, the T-shaped member forms a core for capturing the biasing spring 74 and maintaining its vertical position relative to the front nosepiece 60. The plate 68 forms a bearing surface for the top end of the spring 74.

A control assembly 76 is disposed on the vertical portion 42 of the housing 38 adjacent a trigger assembly 78. The control assembly 76 is similar to the control assembly described in detail in U.S. Pat. No. 4,550,643, assigned to the same assignee as the present invention, hereby incorporated by reference. The control assembly 76 controls the operation of the drive assembly and includes a downwardly extending safety 80 (similar to the safety 62 in U.S. Pat. No. 4,550,643. The safety 80 is normally in the downward position when the nosepiece assembly 32 is not in engagement with a workpiece and prevents operation of the tool.

When the nosepiece assembly 32 engages a workpiece, the magazine assembly 47 and nosepiece assembly 32 pivots upwardly against the force of the biasing spring 74. A control lever 82, rigidly connected to the side of the nosepiece assembly 32, engages the safety 80 and urges it upward, to enable the tool 15 to be operated under the control of the trigger assembly 78. When the nosepiece assembly 32 is not in engagement with a workpiece, the control lever 82 positions the safety 80 to prevent operation of the tool.

Another important aspect of the invention relates to the furniture spring clip guide 64 formed in the nosepiece assembly 32 to allow the furniture spring clips 20 to be positioned with respect to the tool 15. More particularly, the front nosepiece 60 is formed in an "I" configuration, defining a pair of opposite disposed walls 86 and an integrally formed transverse web portion 88. The furniture spring clip guide 64 is adapted to position a J-type furniture spring clip 20 with respect to the nosepiece assembly 32. More specifically, the shank portion 24 of the furniture spring clip 20 is received between the two opposing walls 86 of the guide 64, substantially perpendicular thereto. The oppositely disposed walls 86 are spaced apart to be slightly wider than the width of a J-type furniture spring clip. As best shown in FIG. 7, the oppositely disposed walls 86 extend downwardly from the bottom edge 87 of transverse web portion 88 forming a pocket 89 having a height at least the thickness of the shank portion 24 of the J-type furniture spring clip 20 in order to allow the guide 64 to capture the shank portion 24 of the furniture spring clip 20 between the opposing walls 86. Since the drive track 36 is disposed adjacent the furniture clip guide 64, once the furniture spring clip 20 is captured by the guide 64, the slots 26, the apertures 28 in the furniture spring clip 20, will be aligned relative to the drive track 36 to allow staples 30 to be driven therethrough.

As discussed above, two staples 30 are used to secure the furniture spring clips 20 to the furniture frame 21. In order to drive a fastener 30 through the slots 26 disposed on the shank portion 24 of the furniture spring clip 20, the tool 15 is positioned substantially vertically with respect to the workpiece such that the opposing walls 86 and the transverse web portion 88 are generally perpendicular to the plane of the shank portion 24 of the furniture spring clip 20. In order to provide longitudinal positioning of the furniture spring clip 20 with respect to the drive track 36, a stop 91 may be formed on the rear nosepiece 62. This stop 91 may be utilized to position the furniture spring clip 20 with respect to the slots 26 in the shank portion 24 of the furniture spring clip 20 or the apertures 28 in the short depending leg portion 22.

When a staple 30 is being driven into the slots 26 of the shank portion 24, the short depending leg portion 22 is captured in the inset 93 defined by the transverse web portion 88 of the guide 64. When a staple 30 is being driven through the apertures 28 in the short depending leg portion 22, the short depending leg portion 22 is captured relatively perpendicularly to the opposing wall portions 86 of the guide 64. The tool 15 is positioned such that an edge 94 of the short depending leg portion 22 of the furniture spring clip 20 engages the stop 91 formed on the rear nosepiece 62. This will align the drive track 36 with the apertures 28 to allow a staple 30 to be driven through the apertures 28 and the slots 26 and into the workpiece. The force of driving the staple into the short depending leg 22 bends the leg down to enclose the spring 23 in the spring clip 20.

A notch 92 may be centered in the stop 91 to allow the tool 15 to fasten support springs (not shown), typically used to span the vertical back support space in the furniture frame, directly to the wood frame member. In operation the spring would be captured by the notch 92 to center the staple 30 over the spring when it is driven.

A magnet assembly 95 may be disposed in the inset 93 to hold a furniture spring clip 20 until it can be secured to the furniture frame. The magnet assembly 95 is positioned within the inset 93 to hold the short depending leg portion 22 of the furniture spring clip 20 once the shank portion 24 is positioned in the guide 64.

The magnet assembly 95 includes a bar magnet 97 and a plate 99 each having a slot 101. The slots 101 allow the vertical position of the magnet assembly 95 with respect to the nosepiece assembly 32 to be adjusted. The bar magnet 97 is sized to be received in the inset 93. A fastener 103 is received in the slots 101 in the bar magnet 97 and in the plate 99 and into a threaded aperture (not shown) in the inset 99.

Many modifications and variations of the present invention are possible in light of the above teachings. Thus it is to be understood that, within the scope of the appended claims, the invention may be practiced otherwise than as specifically described.

What is claimed and sought to be secured by a Letters Patent of the United States is:

1. A fastener driving tool for securing J-type furniture clips having a first depending leg portion with one or more first fastener receiving apertures and a second depending leg portion relatively longer than said first depending leg portion with one or more second fastener receiving apertures to a workpiece comprising:

a housing;

a handle coupled to said housing;

a drive assembly disposed in said housing for driving fasteners in a feed track into a workpiece;

a nosepiece assembly forming a drive track, disposed adjacent said drive assembly;

a magazine operatively coupled to said nosepiece assembly for supplying fasteners to said drive track; and means spaced apart from said handle for vertically aligning said drive track with said one or more fastener receiving apertures to allow fasteners to be driven therethrough.

2. A fastener driving tool for securing a clip having a first depending leg portion with one or more first fastener receiving apertures and a second depending leg portion with one or more second fastener receiving apertures to a workpiece comprising:

a housing;

a handle coupled to said housing;

a drive assembly disposed in said housing for driving fasteners to a drive track into the workpiece;

a nosepiece assembly forming a drive track, disposed adjacent said drive assembly;

a magazine, operatively coupled to said nosepiece assembly for supplying fasteners to said drive track; and means spaced apart from said handle for vertically aligning said drive track with said first and second fastener receiving apertures to allow fasteners to be driven therethrough.

3. A fastener driving tool as recited in claim 2, wherein said aligning means is disposed adjacent said nosepiece assembly.

4. A fastener drive tool as recited in claim 2, further including a control assembly having a reciprocably mounted safety extending outwardly from said housing for preventing the operation of the tool when the nosepiece is not in engagement with a workpiece.

5. A fastener driving tool as recited in claim 4, wherein said magazine assembly includes a control lever interlocked with said safety.

6. A fastener driving tool as recited in claim 4, wherein said safety disables said tool when displaced downwardly and enables said tool when displaced upwardly.

7. A fastener driving tool as recited in claim 4, wherein said housing includes a rear depending leg, pivotally mounted to a rear portion of said magazine assembly.

8. A fastener driving tool as recited in claim 4, wherein said housing includes a plate having one or more depending flanges with slots for slidably mounting a front portion of said nosepiece assembly.

9. A fastener driving tool as recited in claim 2, wherein said aligning means is formed in an "I" configuration defining a pair of opposing walls and a transverse web portion.

10. A fastener driving tool as recited in claim 9, wherein said opposing walls extend downwardly from said transverse web portion defining a pocket.

11. A fastener driving tool as recited in claim 10, further including a stop for positioning the clip along its longitudinal axis with respect to the nosepiece.

12. A fastener driving tool as recited in claim 9, wherein said web portion defines an inset between said opposing wall portions for receiving said depending leg portion of said clip.

13. A guide for use with a fastener driving tool having a drive track for driving fasteners into a workpiece for positioning the drive track relative to a J-type furniture spring clip having a first depending leg with one or more first fastener receiving apertures and a second relatively shorter depending leg with one or more second fastener receiving apertures comprising:

first means for vertically aligning said drive track with respect to one or more first fastener receiving apertures to allow fasteners to be driven therethrough; and second means for vertically aligning said drive track with respect to said second fastener receiving apertures to allow fasteners to be driven therethrough, said first means and said second means spaced apart from said handle.

14. A guide for use with a staple driving tool having a drive track for positioning the drive track with respect to furniture clips having one or more pairs of staple receiving apertures and for positioning said drive track with respect to a furniture spring defining two free ends;

means for vertically aligning said drive track with respect to the said one or more pairs of staple receiving apertures to allow staples to be driven therethrough; and means for capturing a free end of said furniture spring and vertically aligning said drive track with respect to said free end to allow staples to directly secure said free end to a workpiece.

15. A fastener driving tool for securing a spring defining two free ends to a workpiece comprising:

a housing;

a drive assembly disposed in said housing for driving staples in a drive track into a workpiece;

a nosepiece assembly forming a drive track;

a magazine for supplying staples to said drive track; and means for capturing a free end of said spring and vertically aligning said drive track with respect to said free end to allow a staple to directly secure said free end to a workpiece.

16. A fastener driving tool as recited in claim 15, wherein said positioning means includes a notch.

17. A staple driving tool for securing furniture clips having a first depending leg portion with one or more pairs of first staple receiving apertures and a second depending leg portion relatively longer than said first depending leg portion having one or more pairs of second staple receiving apertures and for securing a furniture spring defining two free ends to a furniture frame comprising:

a housing;

a handle coupled to said housing;

a drive assembly disposed in said housing for driving staples in a drive track into a workpiece;

a nosepiece assembly forming a drive track;

a magazine assembly for supplying staples to the drive track; and a furniture clip guide spaced apart from said handle formed adjacent said nosepiece for vertically aligning said drive track with said first staple receiving apertures to allow the staples to be driven therethrough; and means for capturing a free end of said furniture spring and vertically aligning said drive track with respect to said free end to allow staples to directly secure said free end to a workpiece.

18. A fastener driving tool as recited in claim 17, wherein said guide is integrally formed with said nosepiece assembly..

19. A fastener driving tool as recited in claim 17, wherein said positioning means is formed in an "I" configuration defining a pair of opposing walls and a transverse web portion.

20. A fastener driving tool as recited in claim 19, wherein said web portion defines an inset between said opposing wall portions for receiving said first or second depending leg portions of said furniture clip.

21. A fastener driving tool as recited in claim 12, wherein said opposing walls extend downwardly from said web portion defining a pocket.

22. A fastener driving tool as recited in claim 12, further including a stop for positioning the furniture clip along its longitudinal axis with respect to the nosepiece.

23. A fastener driving tool as recited in claim 21, wherein said stop includes a notch for positioning the tool with respect to a spring.

24. A fastener driving tool as recited in claim 17, further including means for holding said furniture spring clip until it can be fastened to a workpiece.

25. A fastener driving tool as recited in claim 24, wherein said holding means includes a magnet.

* * * * *